United States Patent [19]

Montealegre

[11] Patent Number: 4,534,505

[45] Date of Patent: Aug. 13, 1985

[54] EXPANDABLE FOOD CONTAINER

[75] Inventor: James W. Montealegre, St. Paul, Minn.

[73] Assignee: Container Corporation of America, Chicago, Ill.

[21] Appl. No.: 569,450

[22] Filed: Jan. 9, 1984

[51] Int. Cl.[3] ..... B65D 5/00

[52] U.S. Cl. ..... 229/33; 229/8; 229/41 C; 426/124

[58] Field of Search ..... 229/41 R, 41 B, 41 C, 229/33, 8, 39 R, 30, 31 FS, 22, 41 D; D9/431–433; 426/107, 111, 124

[56] References Cited

U.S. PATENT DOCUMENTS

| | | | |
|---|---|---|---|
| D. 214,134 | 5/1969 | Niemuller | D9/431 X |
| 648,182 | 4/1900 | Webb | 229/8 |
| 1,649,088 | 11/1927 | Tinsley | 229/8 |
| 1,909,649 | 5/1933 | Bayless | 229/41 C |
| 2,067,998 | 1/1937 | Williamson | 229/8 |
| 2,815,164 | 12/1957 | Painter | 229/8 |
| 4,279,933 | 7/1981 | Austin et al. | 229/41 C X |

FOREIGN PATENT DOCUMENTS

| | | | |
|---|---|---|---|
| 690054 | 4/1953 | United Kingdom | 229/22 |
| 739103 | 10/1955 | United Kingdom | 229/41 C |

*Primary Examiner*—Allan N. Shoap
*Assistant Examiner*—Bryon Gehman
*Attorney, Agent, or Firm*—Richard W. Carpenter

[57] ABSTRACT

A package for holding unpopped popcorn while it is being popped in an oven and which is readily expandable for holding the popcorn after it has been popped, which package is formed from a unitary blank of foldable sheet material such as paperboard.

1 Claim, 9 Drawing Figures

EXPANDABLE FOOD CONTAINER

BACKGROUND OF THE INVENTION

This invention relates generally to foldable or collapsible cartons, and more particularly to an expandable carton for use in the packaging and popping of popcorn.

The invention of the present application is an improvement over cartons of the type disclosed in U.S. Pat. No. 4,279,933.

SUMMARY OF THE INVENTION

An object of the present invention is to provide a new and improved expandable food package formed from a unitary blank of paperboard which is adapted to hold unpopped popcorn while it is being popped and to expand to serve as a bowl for holding the popped popcorn.

A more specific object of the invention is the provision of a package of the type described in U.S. Pat. No. 4,279,933 but which has additional features of stability and stacking strength by virtue of its novel construction.

Another specific object of the invention is the provision of a package of the type described which has an elongated diamond-shaped bottom panel with side walls extending upwardly and outwardly therefrom which form a hexagonal configuration at the upper end of the carton.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 6:
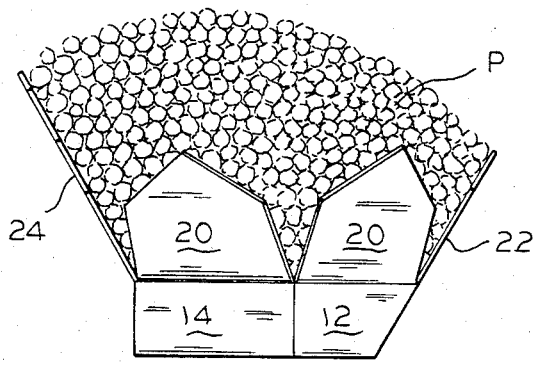
FIG. 6 is a side elevational view of the structure shown in FIG. 5, but illustrating the carton after it has been expanded to accommodate holding of the popped popcorn therein.

Referring now to the drawings for a better understanding of the invention, and particularly to FIGS. 1 through 6, it will be seen that the carton indicated generally at C may be formed from the unitary blank B of foldable sheet material such as paperboard. The carton is adapted to enclose an expandable item, such as unpopped popcorn, up to and during the time that it is being popped and expanded, and which carton is also expandable, as best seen in FIG. 6, for serving as a bowl to hold the expanded or popped popcorn, indicated generally at P.

Figure 1:
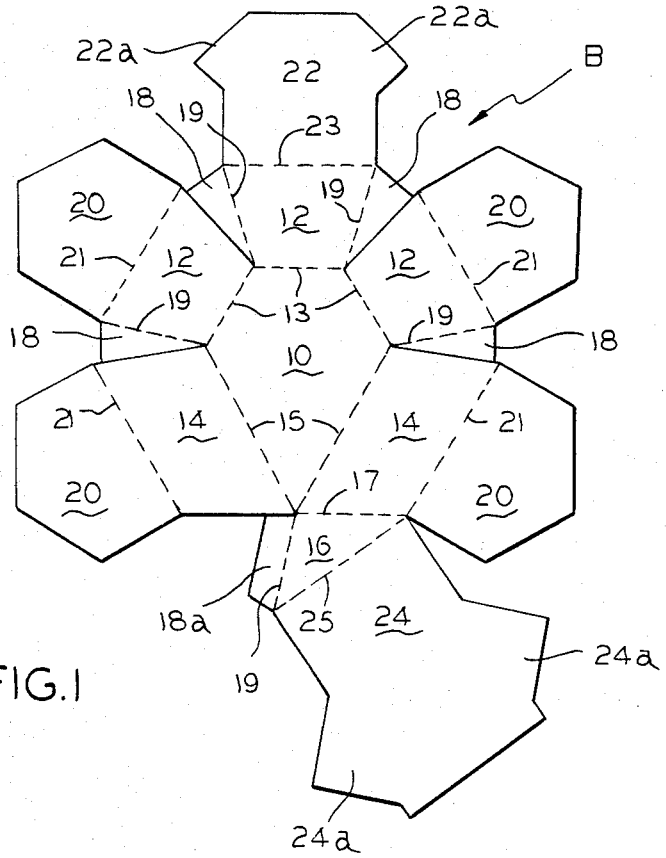
FIG. 1 is a plan view of a blank of foldable sheet material from which the carton illustrated in the other views may be formed.

As previously mentioned, carton C may be formed from the unitary blank B of foldable sheet material illustrated in FIG. 1. The carton includes a preferably diamond-shaped, pentagonal bottom wall panel 10 having a plurality of side wall panels of varying shapes foldably joined to side edges thereof and upstanding therefrom.

As best seen in FIG. 1, three similar first side wall panels 12 are foldably joined to adjacent side edges of bottom panel 10 along fold lines 13. These first side wall panels 12 each have the shape of a trapezoid.

Foldably joined to the other two side edges of bottom panel 10 on fold lines 15 are a pair of second side wall panels 14 each of which has the shape of a parallelogram A third side wall panel 16 in the form of a triangle is foldably joined on fold line 17 to one side edge of one of the second side wall panels 14.

The side wall panels may be joined to each other by means of a series of corner flaps, with triangular corner flaps 18 foldably joined on fold lines 19 to certain of the side wall panels 12 and 14, and a generally rectangular corner flap **18*a* foldably joined on fold line 19*a* to one side edge of third side wall panel 16**.

It will be noted that all of the side wall panels are disposed to extend upwardly and outwardly from bottom wall 10 except for side wall panel 16, which is disposed to extend generally straight up from bottom wall panel 10.

Foldably joined to the upper edges of the side wall panels are a series of closure flaps. Pentagonally shaped first closure flaps 20 are foldably joined on fold lines 21 to the upper edges of the respective first side wall panels 12.

A second closure flap 22 is foldably joined along fold line 23 to the upper edge of the centermost first side wall panel 12. Panel 22 is generally rectangular but with a pair of generally triangular wings **22*a*** extending outwardly from opposite sides thereof.

Foldably joined on fold line 25 to the upper edge of side wall panel 16 is a third closure panel 24 which is somewhat similar in shape to previously described second closure panel or flap 22. Panel 24 is also provided with a pair of oppositely extending triangular shaped wings or extension **24*a***.

Figure 2:
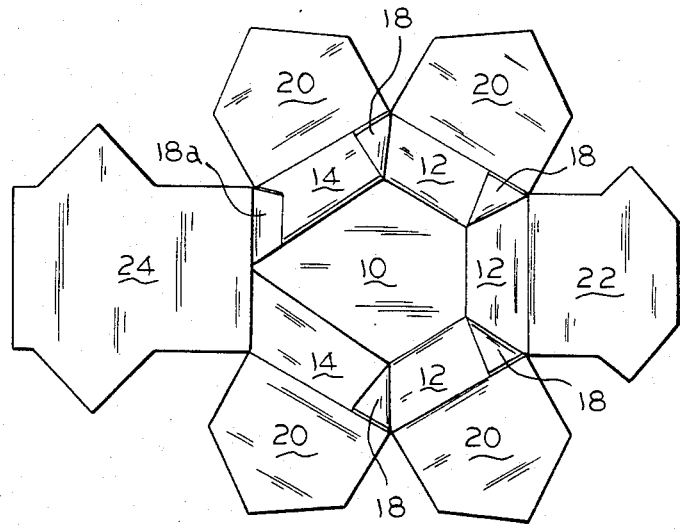
FIGS. 2, 3, and 4 are plan views of the structure illustrated in FIG. 1, but showing various stages in the formation of the carton from the blank.
Figure 3:
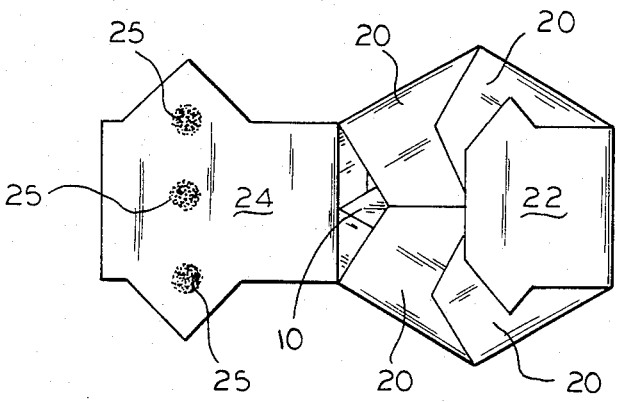
Figure 4:
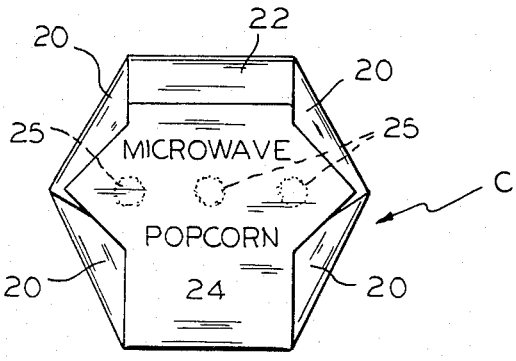
Figure 5:
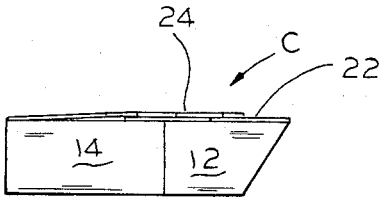
FIG. 5 is a side elevational view of the structure illustrated in FIG. 4.

In forming from the carton from the blank, as best seen in FIGS. 2, 3 and 4, the first closure flaps 20 are first folded inwardly over the product packaged therein, which is preferably unpopped popcorn, and then second closure flap 22 is folded to overlie the first closure flaps. Then the third closure flap 24, which is the largest of the closure flaps, is folded so as to overlie portions of all of the other closure flaps and be detachably adhesively secured as at 25 to the underlying flaps and particularly to flap 22.

Figure 7:
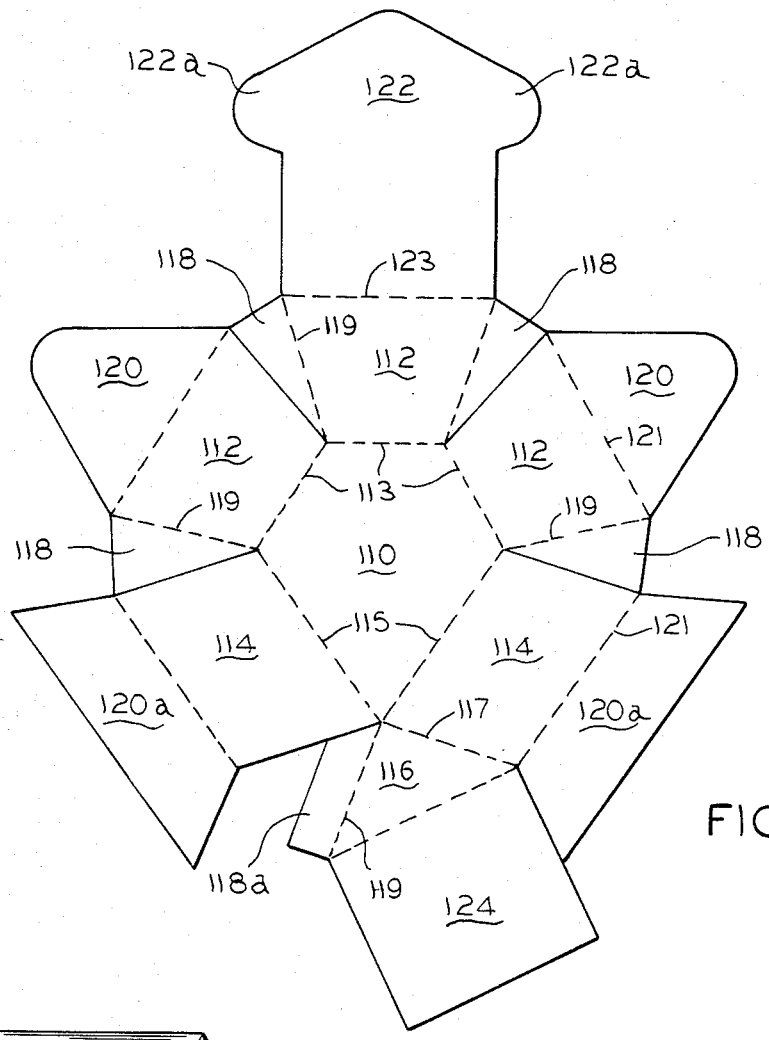
FIG. 7 is a view similar to that of FIG. 1, but illustrating a slightly modified form of the invention.
Figure 8:
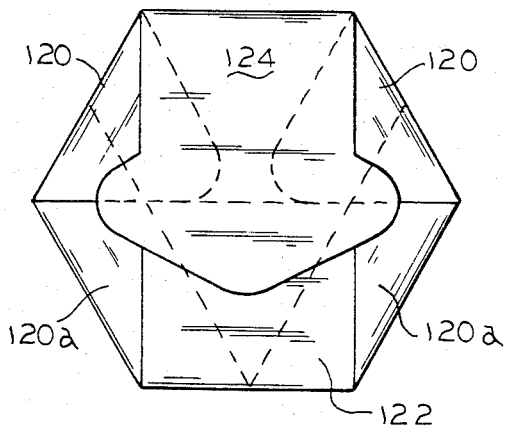
FIG. 8 is a top plan view of an erected and closed carton formed from the blank illustrated in FIG. 7.
Figure 9:
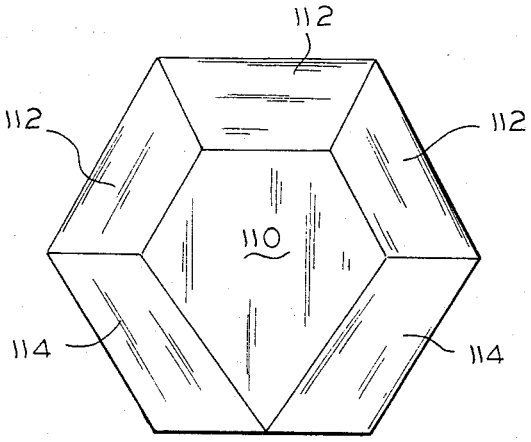
FIG. 9 is a bottom plan view of the structure illustrated in FIG. 8.

Turning now to FIGS. 7–9, it will be seen that a slightly modified form of the invention is shown.

The structure is similar to that of the other views and the elements corresponding to those of the previous views have been identified by corresponding numerals.

Certain of the first closure flaps 120 have been formed as triangles instead of pentagons, and the outer corners have been rounded. Also, the corners on the wings **122*a* of second closure flap 122** have been rounded.

Other first closure flaps 12*a* have been formed as quadrilaterals with downwardly converging side edges.

Additionally, third closure flap 124 does not have the wings of the corresponding flap of the first embodiment.

Both embodiments of the invention are the same in operation and function.

In describing the operation of the package, after it has been filled with unpopped popcorn and placed in an oven, as the popcorn is popped and expands the closure flaps become separated or detached from each other and move outwardly to the position shown in FIG. 6, so the package is capable of serving as a bowl to retain the popped popcorn.

I claim:

1. An expandable package for holding unpopped popcorn in an oven and which is readily openable and expandable for holding said popcorn after it has been popped, said package being pentagonal at the botom and hexagonal at the top and being formed from a unitary blank of foldable sheet material, such as paperboard, and comprising:

(a) an elongated pentagonal bottom wall panel having a plurality of side wall panels foldably joined to side edges thereof, and to each other, and sloping upwardly and outwardly therefrom to present at the upper edges thereof a hexagonal configuration;

(b) said side wall panels including:

(i) three trapezoid shaped first panels foldably joined to three adjacent side edges of said bottom wall panel;

(ii) two parallelogram shaped second panels foldably joined to the remaining two side edges of said bottom wall panel;

(iii) said first and second panels defining five side wall panels which outline at the bottom thereof the pentagonal shape at the bottom of the package;

(c) one triangular shaped third panel foldably joined to a side edge of one of said second panels and forming a sixth side wall panel located between said second panels with one of the sides of said triangular-shaped third panel located at the top of said package to outline in combination with the top edges of said five side wall panels the hexagonal shape at the top of the package;

(d) six top closure panels foldably joined to upper edges of respective side wall panels and being folded over into overlapped relation to form a hexagonal shaped cover;

(e) certain of said closure panels being detachably secured with respect to each other, so that when popcorn in the package expands said closure flaps can separate from each other to form an open top receptacle.

* * * * *